United States Patent [19]

Strand

[11] Patent Number: 4,707,046

[45] Date of Patent: Nov. 17, 1987

[54] SAFETY BREAKAWAY ELECTRICAL CONNECTOR CONSTRUCTION

[75] Inventor: Theodore L. Strand, Safety Harbor, Fla.

[73] Assignee: Liquidometer Corporation, Tampa, Fla.

[21] Appl. No.: 884,034

[22] Filed: Jul. 10, 1986

[51] Int. Cl.[4] ..... H01R 13/633

[52] U.S. Cl. ..... 439/314; 439/550

[58] Field of Search ..... 339/89 R, 89 M, 88 R, 339/90 R, 90 C, 48, 49 B, 126 R, 128, 129, 10

[56] References Cited

U.S. PATENT DOCUMENTS

| | | | |
|---|---|---|---|
| 947,154 | 1/1910 | Freeman | 339/129 |
| 2,605,315 | 7/1952 | Hargett | 339/89 M |
| 3,364,455 | 1/1968 | Nodfelt | 339/90 R |
| 3,711,815 | 1/1973 | Pierce et al. | 339/90 R |
| 3,745,511 | 7/1973 | Fussell | 339/90 R |
| 3,790,922 | 2/1974 | Normann | 339/126 R |
| 4,445,743 | 5/1984 | Bakker | 339/89 M |

FOREIGN PATENT DOCUMENTS

| | | | |
|---|---|---|---|
| 209831 | 1/1924 | United Kingdom | 339/89 M |
| 704464 | 2/1954 | United Kingdom | 339/89 M |

*Primary Examiner*—John McQuade

*Attorney, Agent, or Firm*—H. Gibner Lehmann; K. Gibner Lehmann

[57] ABSTRACT

The invention provides a safety electrical connector construction in the form of electrical receptacles carried by a weatherproof housing on a front panel. The receptacles are of insulating material, with attached contactor pins having exposed exterior faces adapted for engagement by cooperable spring-loaded pins of a line plug from a liquid transfer facility that receives electrical information for monitoring tank filling operations. The receptacles have collars which interlock with the line plugs whereby the latter must be manually released prior to the vehicle being driven off after termination of the filling. The mounting of the receptacles includes unique simplified detent means which are arranged to yield under excessive forces experienced thereby, and to release the receptacles from their supporting panels in the case of an emergency, such as if the driver of a vehicle would forget to uncouple the line plug and would drive the vehicle off with the line still connected. Such emergency release results in separation of the electrical connections in the housing, which connections can be especially designed to be separable and easily re-connected at any later time.

18 Claims, 15 Drawing Figures

26
24
82
32a
72a
36a
70a
58a
36a
84
26
2
32
72
70
20
36
58
2
24
22
26

78

26
22
20
24
60
64
76
30
52
68
78
54
66
56
32
34b
36b
88
92
70
48
38
90
36
40
74
42
46
44
28
62
50
34
80
58
22
26

SAFETY BREAKAWAY ELECTRICAL CONNECTOR CONSTRUCTION

NO CROSS REFERENCES TO RELATED APPLICATIONS STATEMENT AS TO RIGHTS TO INVENTIONS MADE UNDER FEDERALLY-SPONSORED RESEARCH AND DEVELOPMENT

Research and development of the present invention and application have not been Federally-sponsored, and no rights are given under any Federal program.

BACKGROUND OF THE INVENTION

Field of the Invention

This invention relates to electrical connectors as used to join electrical information lines at liquid storage and transfer facilities, and more particularly to multi-conductor connectors at such facilities, having interlocking attachment means by which mating contact parts are maintained in engagement with each other.

DESCRIPTION OF THE RELATED ART INCLUDING INFORMATION DISCLOSED UNDER 37 CFR §§ 1.97–1.99

Connectors as heretofore provided and employed in monitoring lines for use at liquid storage and transfer facilities, such as large storage tanks and tank trucks and the like, utilized interlocking attachment devices where separable connections were necessary, in order to insure continuity of circuitry from the sensing elements to the response and control equipment. Where a line from the transfer facility was to be plugged into a receptacle board or housing, the line plug usually employed bayonet pins which were received in cooperable slots at the receptacle site, to effect the desired continuity and insure against inadvertent separation and loss of signal during the filling operation. Upon termination of the filling of a tank truck, the line plug was manually removed, usually by the driver of the vehicle, prior to driving off.

There have been occasions when the line plug was not first manually disconnected from the receptacle assemblage prior to the vehicle being driven off. Because of the positive interlocking nature of the connectors, this has resulted in considerable damage to equipment, as well as down time and consequent cost.

SUMMARY OF THE INVENTION

The above disadvantage and drawback of prior interlocking electrical connectors as used in monitoring operations at tank filling stations are obviated by the present invention, which has for one object the provision, for use on a tank truck or carrier vehicle, of a novel and improved safety breakaway electrical connector of the kind having an interlock which is cooperable with a line plug from the transfer facility, said connector being especially constituted so that any forceful, improper inadvertent pull-away of the coupled line plug will not cause extensive damage to the outlet connection of the vehicle, line plug or the monitoring equipment located at the transfer facility.

Another object of the invention is to provide an improved breakaway electrical connector as above described, wherein upon the occasion of forceful and improper pull-away of the line plug, there occurs an intentional, automatic breakaway which only requires a minimal amount of subsequent repair, such intentional breakaway being at a designated point in the outlet connection or receptacle box, where replacement and repair can be most readily effected.

Still another object of the invention is to provide an improved breakaway electrical connector in accordance with the foregoing, which is especially simple and economical to fabricate.

A still further object of the invention is to provide an improved breakaway electrical connector as above set forth, which is reliable in its intended operation of insuring the integrity of the circuitry yet minimizing damage to equipment if excessive, inadvertent forces are brought to bear on it.

Yet another object of the invention is to provide an improved electrical connector as characterized, which does not require special or complicated tooling and which utilizes structures that are already known and available with but little modification.

A feature of the invention is the provision of a unique selectively-operable detent device that is especially small and compact, and applicable to conventional receptacle shapes and configurations without requiring additional space or accommodation Other features and advantages will hereinafter appear.

In accomplishing the above objects the invention provides a receptacle body of insulating material having imbedded circuit means in the form of parallel-extending metal pins with exposed ends at opposite sides of the body. An attachment ring is carried at one of said sides, having bayonet slots for engagement with suitable pins of a line cord plug. The receptacle body extends through a panel opening, with the attachment ring engaging one face of the panel. At the opposite panel face, the receptacle body has an outer annular groove to receive a snap ring retainer by which the body is held against removal. One wall of the annular groove is made sloping or angular to such an extent that excessive forces exerted on the receptacle by the line plug body can cause the snap ring to expand and leave the groove, whereby the body is then free to be pulled from the supporting panel with the line plug. Separation of fine connection wires or terminals attached to the receptacle body constitute the only damage incurred as a result of such excessive forces, such as occur from inadvertent leaving of the tank truck without first manually disconnecting the line plug from the receptacle.

DESCRIPTION OF THE PREFERRED EMBODIMENT

Figure 1:
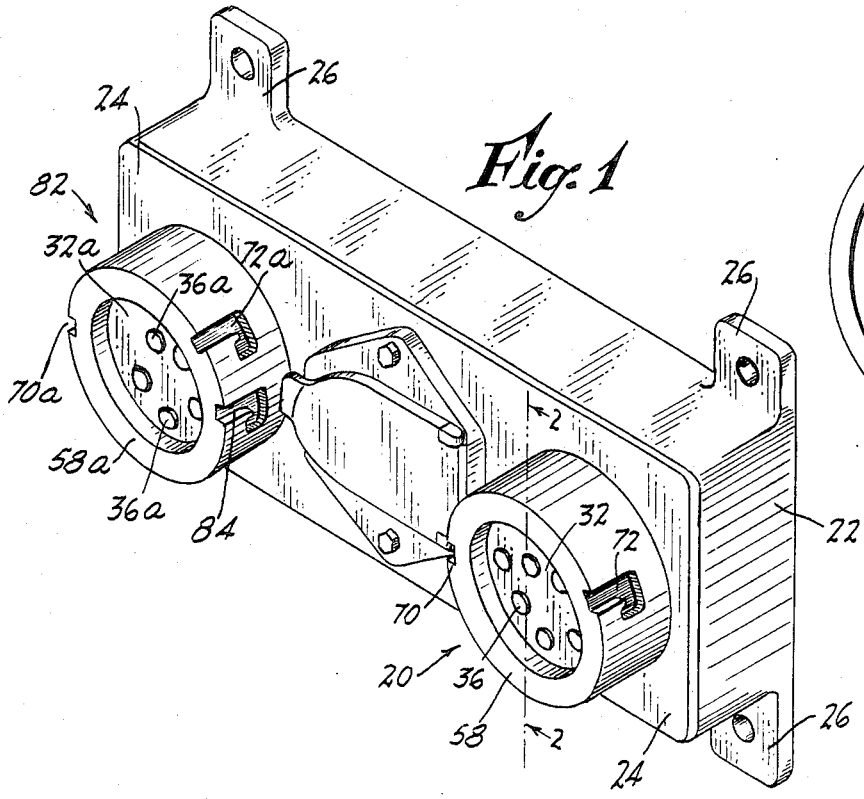
FIG. 1 is a perspective view of a safety breakaway connector construction according to the invention, as adapted for use in connection with sensing elements of a vehicle to transfer facilities such as petroleum storage and distribution yards or farms.

Considering first the embodiment of the invention illustrated in FIGS. 1–8, the Thermistor type connector construction of the invention as shown therein is indicated generally by the numeral 20 and is seen as mounted on an enclosure or housing 22 having a front plate or panel 24. The housing 22 is conveniently formed as an aluminum casting, having mounting lugs 26 by which it can be secured to a mounting surface of a tank truck.

The connector assemblage 20 is adapted to be engaged by a plug fitting 28 at the end of a cable 30 (FIG. 2) extending from monitoring equipment such as that provided at a tank farm for petroleum products (not shown) so as to receive electrical data with respect to the extent of filling of the tank on the truck, which is receiving the liquid product.

The assemblage 20 comprises a receptacle body 32 in the form of a cylindrical member constituted of insulating material such as Delrin (a registered trademark). Press-fitted in the body are shouldered contact pins 34 that constitute circuit means which present conductors or contact surfaces 36 that are accessible at the exterior of the housing, and conductors or contact devices 38 that are are disposed at the interior of the housing. The said contact devices 38 can comprise threaded bores 39, terminal screws 40 and frangible ring terminals 42 secured to the threaded bores 39 at the inner ends of the pins 34, such terminals being capable of breaking away under excessive stresses, and having fine wire leads 44 which also can readily break away under unusual stresses.

Figure 2:
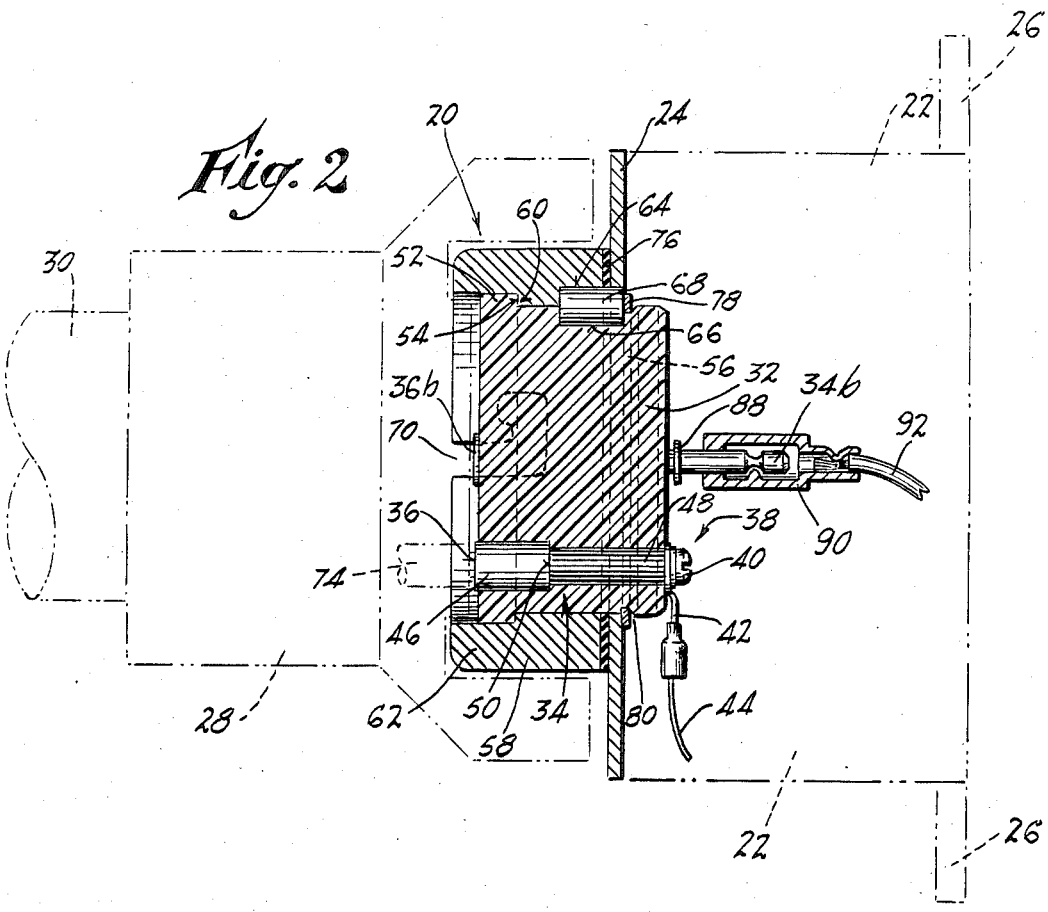
FIG. 2 is an axial sectional view of one receptacle assemblage of FIG. 1, taken on the line 2—2 of this figure and showing in phantom an attached line plug fitting and line from a delivery vehicle (not shown). The shown connector assemblage is for establishing circuitry to what is herein termed a "Thermistor Control".
Figures 3, 4, 5, 6, 7, 8, 9, 10, 11, 12, 13, 14:
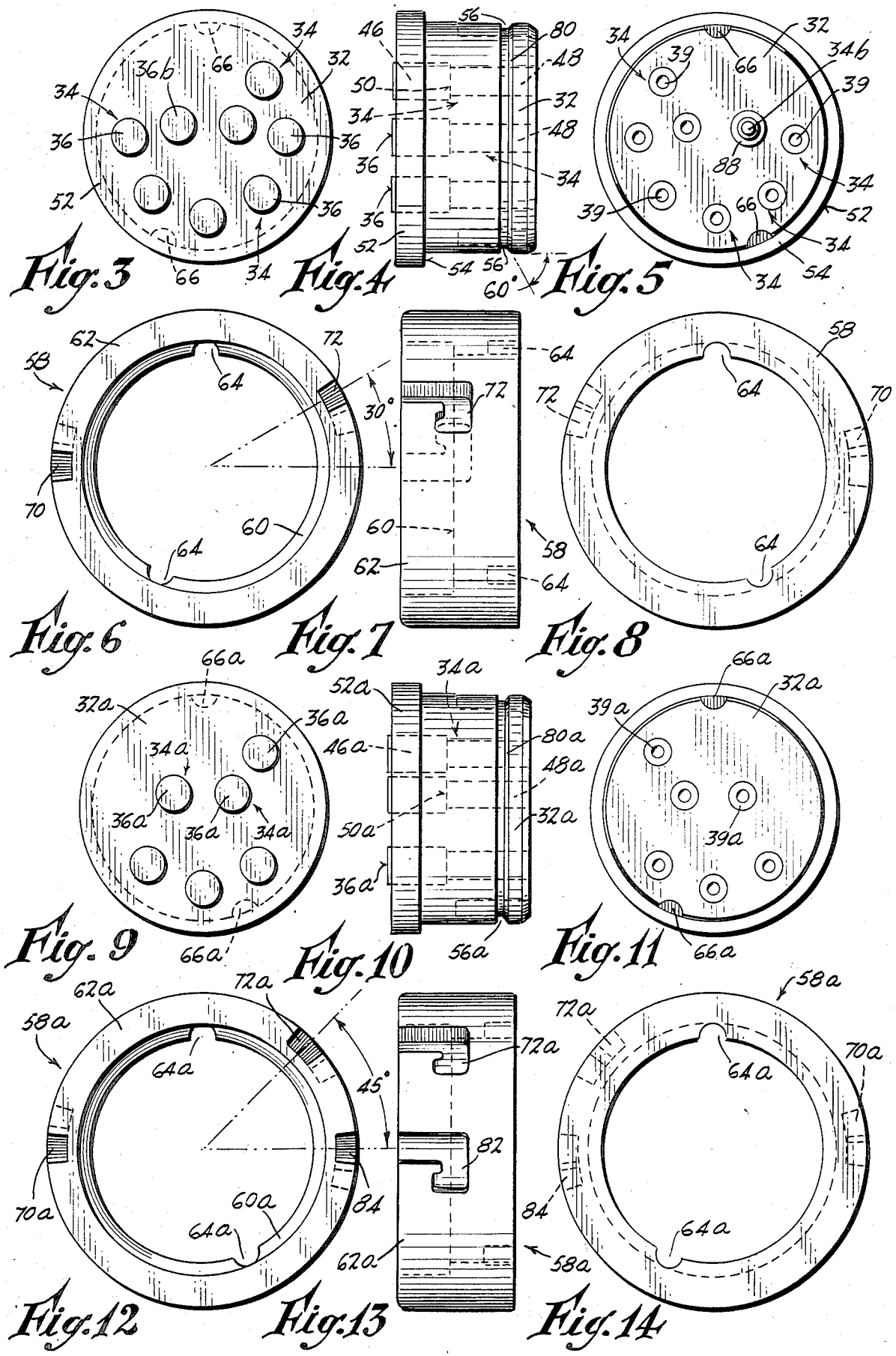
FIG. 3 is a front elevational view of the receptacle body and circuit means thereof, of the receptacle assemblage of FIG. 2.
FIG. 4 is a side elevational view of the receptacle body of FIG. 3.
FIG. 5 is a rear elevational view of the receptacle body of FIGS. 3 and 4.
FIG. 6 is a front elevational view of the attachment ring of the receptacle assemblage of FIG. 2.
FIG. 7 is a side elevational view of the attachment ring of FIG. 6.
FIG. 8 is a rear elevational view of the attachment ring of FIGS. 6 and 7.
FIG. 9 is a front elevational view of another receptacle body and circuit means thereof, for establishing connections to what is termed herein an "Optical Control". This receptacle body is illustrated in the leftmost portion of FIG. 1.
FIG. 10 is a side elevational view of the receptacle body of FIG. 9.
FIG. 11 is a real elevational view of the receptacle body of FIGS. 9 and 10.
FIG. 12 is a front elevational view of the attachment ring of the receptacle assemblage shown in the leftmost portion of FIG. 1, for use with an Optical Control.
FIG. 13 is a side elevational view of the attachment ring of FIG. 12.
FIG. 14 is a rear elevational view of the attachment ring of FIGS. 12 and 13.

As seen in FIGS. 2 and 4, the press-fitted pins 34 have large-diameter portions 46 and small diameter portions 48 separated by shoulders 50.

The receptacle body 32 at its front end has an external flange 52 providing an annular shoulder 54, and adjoining its inner end it has an annular groove 56 constituting part of means by which it is secured to the panel 24.

For attachment to the plug fitting 28, an attachment ring 58 is provided, adapted to telescopically receive the receptacle body 32. The ring 58 has an internal shoulder 60 and a large diameter front bore portion 62 which latter receives the flange 52 of the receptacle body 32.

The body 32 and ring 58 have pairs of aligned or registered grooves 64, 66 which receive short dowel pins 68 by which the body 32 and ring 58 are rotatably fixedly oriented with respect to each other.

The attachment ring 58 is provided with a pair of predeterminedly positioned bayonet slots 70, 72 adapted to receive cooperable pins (not shown) in the plug fitting 28, by which the latter can be easily and quickly connected with and locked to the ring 58, and as easily removed therefrom. The plug fitting 28 has spring-loaded contact pins 74 that respectively engage the contact faces 36 of the receptacle body 32, to effect electrical connections thereto, as seen in FIG. 2.

Proper alignment of the spring-loaded contact pins 74 with the contact faces 36 of the receptacle body 32 is effected by the specific placement of the bayonet slots 70, 72. The asymmetrical disposition of the slots 70, 72 prevents improper application of the plug fitting 28, since the latter can only be applied in one given relative rotative position.

Figure 15:
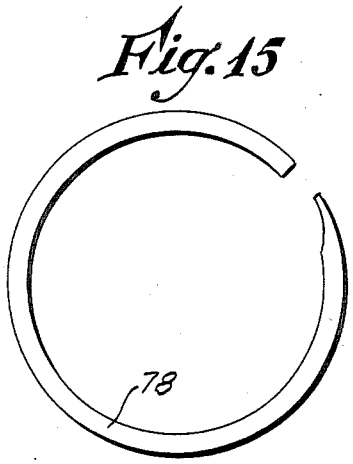
FIG. 15 is a plan view of a snap retainer ring as utilized with the receptacle assemblages of the invention.

In mounting the receptacle assemblage 20 on the panel 24, the body 32 is passed through a suitable opening in the panel with the attachment ring 58 at the front, together with an interposed rubber gasket 76. A snap ring 78 (FIGS. 2 and 15) is placed in the annular groove 56 for engagement with the rear surface of the panel 24, as seen in FIG. 2, in order to secure the assemblage 20 in place.

In accordance with the present invention, the mounting of the assemblage 20 on the panel 24 is so constituted that it can break away if excessive forces are applied to it, as from the plug fitting 28. Occasions have occurred where a tank truck driver inadvertently drove his vehicle away from the filling facility without first removing the plug fitting 28 from the tank truck connector assembly, thus resulting in severe and costly damage to equipment.

In accomplishing such intentional breakaway the invention provides a simple and unique means in the form of an angled configuration of the annular groove 56 at the inner end of the receptacle body. As seen in FIGS. 2 and 4, the inner face or wall 80 of the groove 56 makes an angle with respect to the axis of the body, and we have found that by the provision of such angle the snap ring 78 will expand and release the body 32 if excessive forces are experienced by the latter and its attachment ring 58, as would occur where a vehicle is driven away without first disconnecting the plug fitting 28. An angle of 60° as indicated in FIG. 4 has been found to be satisfactory for such purpose, although departures from this specific figure to values between 50° and 70° are possible, depending on the stiffness and make-up of the ring 78 and the fit of the same in the groove 56.

FIGS. 9–14 illustrate another embodiment of the invention, designated generally by the numeral 82 in FIG. 1, which is intended for use with monitoring equipment employing optical sensors. The structures illustrated are substantially similar to those already described, except that the circuit means comprises a total of six pins 34*a* instead of the eight pins 34 utilized in the previous embodiment, and an additional bayonet slot 84 is provided in the attachment ring 58*a* for the receptacle. In FIGS. 9–14, similar characters of reference have been used, with the suffix "a" added, to denote similar components.

As shown, the receptacle body 32*a* has contact inserts or pins 34*a* with front faces 36*a*, large diameter portions 46*a*, small diameter portions 48*a* separated by shoulders 50*a*, and threaded bores 39*a*. Grooves 66*a* provide for keying the body 32*a* with its attachment ring 58*a*, which latter has cooperable grooves 64*a* to receive the dowels, shown in FIG. 2 and labelled 68. The release wall 80*a* of the groove 56*a* is angled to provide the desired spreading of the snap ring 78 under excessive forces.

In the attachment ring 58*a* the provision of three bayonet slots selectively placed, instead of the two bayonet slots of the previous embodiment, prevents the incorrect application of the plug fitting 28 to the receptacle assemblage 82. It is seen that the bayonet slot 72 of the ring 58 makes an angle of 30° with the horizontal, whereas the bayonet slot 72*a* of the ring 58*a* makes an angle of 45° with the horizontal. As thus provided, a single plug fitting is prevented from being interchangeably used with the attachment rings 58 and 58*a* shown herein.

The invention also provides a modified contact pin construction and separable pin termination means at the interior of the housing 22, which is an alternative to the pin 48 or 48*a* structures described above. This modified construction is depicted in FIGS. 2, 3 and 5 wherein a loosely fitted contact pin 34*b* having a contact head 36*b* is retained in the body 32 by means of a retainer ring 88. The pin 34*b* projects an extent from the inner wall of the body 32 and carries a readily separable terminal socket 90 that is attached to a lead wire 92. A friction fit is provided between the pin 34*b* and the socket 90, and the pin can have an annular groove as shown to cooperate with a mating nib in the socket. Upon separation of the body 32 from the panel 24, the pin 34*b* merely pulls out of the socket 90, leaving the wiring thereto intact. With this construction, the restoration of the wiring at a later time is simplified and less costly in time and parts.

Variations and modifications of the invention are possible without departing from the spirit thereof.

Each and every one of the appended claims defines an aspect of the invention which is separate and distinct from all others, and accordingly each claim is intended to be treated as such when examined in light of the prior art devices in any determination of novelty or validity.

What is claimed is:

1. A safety breakaway electrical connector construction for a tank truck or carrier vehicle, comprising in combination:

(a) a housing means having an opening in one wall, (b) an electrical receptacle having circuit means, said receptacle being mounted in said wall opening, (c) said circuit means comprising conductors which are disposed at the inside of said housing means and other conductors which are accessible at the exterior of said housing means, (d) attachment means carried by said receptacle at the exterior of said housing means, for interlocking engagement with a cooperable electrical plug fitting of a liquid transfer facility to maintain said plug fitting in attached position on the receptacle, (e) said cooperable plug fitting having conductors adapted for engagement with the said other conductors of the receptacle, (f) electrical connector means disposed in said housing means and engaged with said first-named conductors to providecircuit paths to and from the circuit means of the receptacle, and (g) automatic cooperable yieldable detent means on said housing means and receptacle, for normally yieldably retaining the receptacle positioned in said wall opening, said detent means automatically yielding and releasing the receptacle from the housing means in response to excessive abnormal force applied to said attachment means of the receptacle in a direction away from said housing means.

2. A connector construction as set forth in claim 1, wherein:

(a) the attachment means comprises a ring encircling the receptacle, (b) said ring having a keying device to establish the proper orientation of the electrical plug fitting of the liquid transfer facility.

3. A connector construction as set forth in claim 2, wherein:

(a) said keying device comprises bayonet slots in said ring.

4. A connector construction as set forth in claim 3, wherein:

(a) said bayonet slots are disposed in the exterior surfaces of said ring.

5. A connector construction as set forth in claim 2, wherein:

(a) said receptacle is closely telescopically received in said ring in abutting engagement therewith.

6. A connector construction as set forth in claim 5, wherein:

(a) said ring has an inner annular shoulder, (b) said receptacle having an outer annular shoulder abuttingly engaged with the inner shoulder of the ring to position the latter on the receptacle.

7. A connector construction as set forth in claim 1, wherein:

(a) said detent means comprises an annular external groove in the receptacle, and a snap ring disposed in said groove and adapted to spread apart and snap out of the groove in response to forceful lateral pressures exerted thereon.

8. A connector construction as set forth in claim 7, wherein:

(a) said annular groove has an angled wall to facilitate the snapping out of said snap ring.

9. A connector construction as set forth in claim 2, wherein:

(a) said detent means comprises an annular groove in the receptacle, and a snap ring disposed in said groove and adapted to spread apart and snap out of the groove in response to forceful lateral pressures exerted thereon, said snap ring being spaced from said attachment ring by an amount sufficient to accommodate said one wall of the housing means.

10. A connector construction as set forth in claim 5, wherein:

(a) said detent means comprises an annular groove in the receptacle, and a snap ring disposed in said groove and adapted to spread apart and snap out of the groove in response to forceful lateral pressures exerted thereon, said snap ring being spaced from said attachment ring by an amount sufficient to accommodate said one wall of the housing means.

11. A connector construction as set forth in claim 2, and further including:

(a) aligned notches in said attachment ring and receptacle, and (b) a dowel disposed in the aligned notched to angularly position the attachment ring with respect to the receptacle.

12. A connector construction as set forth in claim 11, wherein:

(a) the attachment ring and the receptacle have additional aligned notches disposed at different points around the periphery of the ring, and (b) an additional dowel disposed in said additional notches.

13. A connector construction as set forth in claim 1, wherein:

(a) said electrical connector means comprises separable portions which can separate when the detent means yields.

14. A connector construction as set forth in claim 13, wherein;

(a) said connector means comprises fine wires which can rupture.

15. A connector construction as set forth in claim 13, wherein:

(a) said connector means comprises a separable pin-and-socket structure disposed in said housing means.

16. A safety breakaway electrical connector construction for a tank truck or carrier vehicle, comprising in combination:

(a) a housing having an opening in one wall, (b) an electrical receptacle having circuit means, said receptacle being mounted in said wall opening, (c) said circuit means comprising conductors which are disposed at the inside of said housing and other conductors which are accessible at the exterior of said housing, (d) attachment means carried by said receptacle at the exterior of said housing, for interlocking engagement with a cooperable electrical plug fitting of a liquid transfer facility to maintain said plug fitting in attached position on the receptacle, (e) said cooperable plug fitting having conductors adapted for engagement with the said other conductors of the receptacle, (f) electrical connector means disposed in said housing and engaged with said first-named conductors to provide circuit paths to and from the circuit means of the receptacle, and (g) cooperable yieldable detent means on said housing and receptacle, for normally yieldably retaining the receptacle positioned in said wall opening, said detent means yielding and releasing the receptacle from the housing in response to excessive abnormal force applied to said attachment means of the receptacle in a direction away from said housing, (h) said detent means comprising an annular external groove in the receptacle, and a snap ring disposed in said groove and adapted to spread apart and snap out of the groove in response to forceful lateral pressures exerted thereon, (i) said annular groove having an angled wall to facilitate the snapping out of said snap ring, (j) the angled wall of the groove making an angle of between 50° and 70° with respect to the axis of the receptacle.

17. A safety breakaway electrical connector construction for a tank truck carrier vehicle, comprising in combination:

(a) a housing having an opening in one wall, (b) a first electrical receptacle having circuit means, said first receptacle being mounted in said wall opening, (c) said circuit means comprising a first set of inner conductors which are disposed at the inside of said housing and a first set of outer conductors which are accessible at the exterior of said housing, (d) first attachment means including a first keying device carried by said first receptacle at the exterior of said housing, for interlocking engagement with a first cooperable electrical plug fitting of a liquid transfer facility to orient said plug fitting and maintain it attached to the first receptacle, (e) said first cooperable plug fitting having conductors adapted for engagement with the said first set of outer conductors of the first receptacle, (f) electrical connector means disposed in said housing and engaged with said first set of inner conductors to provide circuit paths to and from the circuit means of the first receptacle, and (g) cooperable yieldable detent means on said housing and first receptacle, for normally yieldably retaining the first receptacle positioned in said wall opening, said detent means yielding and releasing the first receptacle from the housing in response to excessive abnormal force applied to said attachment means of the first receptacle in a direction away from said housing, (h) said housing having a second opening in one wall, (i) a second electrical receptacle having second circuit means, said second receptacle being mounted in said second wall opening, (j) said second circuit means comprising a second set of inner conductors which are disposed at the inside of said housing and a second set of outer conductors which are accessible at the exterior of said housing, (k) second attachment means including a second keying device to orient a second electrical plug fitting of the liquid transfer facility, said second attachment means being carried by said second receptacle at the exterior of said housing for interlocking engagement with said second cooperable electrical plug fitting, to maintain the plug fitting thereof attached to the second receptacle, (l) said second cooperable plug fitting having conductors adapted for engagement with the said second set of outer conductors of the second receptacle, (m) electrical connector means disposed in said housing and engaged with said second set of inner conductors to provide circuit paths to and from the circuit means of the second receptacle, and (n) cooperable yieldable detent means on said housing and second receptacle, for normally yieldably retaining the second receptacle positioned in said second wall opening, said detent means yielding and releasing the second receptacle from the housing in response to excessive abnormal force applied to said attachment means of the second receptacle in a direction away from said housing, (o) said first and second keying devices being dissimilar, thereby to prevent the said first electrical plug fitting from interlockingly engaging said second attachment means and vice-versa.

18. A connector construction as set forth in claim 17, wherein:

(a) said keying devices comprise bayonet slots at the exterior of the receptacles.

* * * * *